United States Patent [19]

King et al.

[11] 4,289,547

[45] Sep. 15, 1981

[54] AQUEOUS ACIDIC LUBRICANT COATING COMPOSITION AND METHOD

[75] Inventors: Peter F. King, Farmington Hills; George J. Beyer, Troy, both of Mich.

[73] Assignee: Hooker Chemicals & Plastics Corp., Madison Heights, Mich.

[21] Appl. No.: 171,859

[22] Filed: Jul. 24, 1980

Related U.S. Application Data

[63] Continuation-in-part of Ser. No. 64,682, Aug. 7, 1979, abandoned.

[51] Int. Cl.[3] ..... C23F 7/10

[52] U.S. Cl. ..... 148/6.15 R; 148/6.15 Z; 252/49.5; 252/49.8; 252/49.9

[58] Field of Search ..... 148/6.15 R, 6.15 Z; 252/49.5, 48.9, 49.9, 51.5 A

[56] References Cited

U.S. PATENT DOCUMENTS

| | | | |
|---|---|---|---|
| 2,840,498 | 6/1958 | Logue et al. | 148/6.15 Z |
| 2,850,418 | 9/1958 | Otto et al. | 148/6.15 Z |
| 3,525,651 | 8/1970 | Smith | 148/6.15 Z |

FOREIGN PATENT DOCUMENTS

| | | | |
|---|---|---|---|
| 1421386 | 1/1976 | United Kingdom | 148/6.15 Z |

*Primary Examiner*—Ralph S. Kendall

*Attorney, Agent, or Firm*—Arthur E. Kluegel; Richard P. Meuller

[57] ABSTRACT

A composition and a method for applying a lubricant coating to clean metal surfaces prior to subjecting them to metal forming operations. The composition comprises a concentrate which is adapted to be diluted with water, if desired, to produce an aqueous acidic operating bath containing a controlled effective amount of phosphate ions to form a phosphate coating on the clean metal surface in combination with an emulsified organic lubricant agent, an emulsifying agent and an iron chelating agent. The coating composition may further optionally contain a controlled amount of a corrosion inhibiting agent and heavy metal cations for activating the coating bath. The coating composition is applied to a clean metal surface such as by flooding, immersion, spraying, or the like, at temperatures from ambient up to about 200° F. for a period of time sufficient to effect a desired coating magnitude whereafter the parts are dried, preferably at elevated temperatures before forming.

21 Claims, No Drawings

AQUEOUS ACIDIC LUBRICANT COATING COMPOSITION AND METHOD

CROSS REFERENCE TO RELATED APPLICATION

This application is a continuation-in-part of U.S. Ser. No. 64,682, filed Aug. 7, 1979, now abandoned.

BACKGROUND OF THE INVENTION

A variety of compositions and methods have heretofore been used or proposed for use for applying coatings on metal surfaces possessed of lubricating properties to facilitate subsequent metal forming or working operations such as drawing, forging, and the like. Chemical conversion coatings, especially phosphate coatings, have received widespread acceptance for this purpose. Such phosphate conversion coatings are employed in conjunction with supplemental organic lubricating agents such as waxes and soaps to further enhance the lubricity characteristics of the coating formed. It has heretofore been conventional to first subject the metal surfaces to a phosphating treatment to form the requisite phosphate coating thereon, whereafter the parts are water rinsed and thereafter are passed into a lubricant tank for applying the supplemental organic lubricant thereto. The problems associated with such a multiple step pretreatment prior to metal forming operations have somewhat been overcome by coating formulations providing a one-step procedure in forming the necessary lubricant coating thereby substantially reducing the treating time, plant space required, investment in capital equipment and labor required.

Typical one-step methods for forming a lubricant coating on metal surfaces are those disclosed in U.S. Pat. Nos. 2,840,498; 2,850,418; and 3,525,651. In accordance with the methods and compositions disclosed in the aforementioned patents, a lubricating agent is emulsified or dispersed in an aqueous solution containing the conversion coating constituent whereby a conversion coating and a deposition of the lubricant additive is simultaneously effected in a so-called one-step operation. At the completion of the coating operation, the surfaces of the metal parts are dried prior to initiation of the metal forming operations.

A continuing problem associated with one-step processes of the types heretofore known has been the formation of rust on the metal surfaces during the drying stage of the process. The presence of water vapor and the high free acid of the emulsion on the metal parts tends to cause rusting particularly in areas and locations which are difficult to reach by the heated recirculating air employed during the drying operation. Such a situation frequently arises when bulk quantities of metal parts are processed in bundles and the points of contact between adjacent work pieces precludes adequate entry of drying air. The presence of such rust not only results in an unacceptable surface on the finished product but also substantially increases resistance during the metal working or drawing process increasing die wear and resulting in improperly worked or fractured metal parts.

It has now been discovered that rusting of the metal surfaces during the drying stage can be substantially inhibited by the inclusion of a controlled effective amount of a specific type of rust inhibiting agent in the operating bath without significantly affecting the stability of the emulsion. It has been observed, however, that during use of the bath, iron is dissolved from the metal surfaces processed causing a progressive increase in iron concentration in the bath which tends to reduce the effectiveness of the rust inhibiting agent and promotes emulsion instability.

The present invention overcomes the problems and disadvantages associated with prior art one-step lubricant coating compositions and methods by providing a concentrate useful when diluted with water for forming an operating bath which is of versatile use, effective to produce a satisfactory lubricant conversion coating on a metal surface, which is substantially stable over a broad range of operating conditions, which has a prolonged operating life and which inhibits the formation of rust during the drying stage.

SUMMARY OF THE INVENTION

The benefits and advantages of the present invention are based on the discovery of an aqueous acidic coating composition suitable for treating metal surfaces, and particularly, iron and steel surfaces prior to metal forming operations comprising about 0.2% to about 15% by weight phosphate ions, about 0.3 to about 16% of an emulsified organic lubricant selected from the group consisting of $C_8$ to $C_{40}$ carboxylic acid and alcohols including the esters, mono and polyamine salts, mono and polyalkyl ($C_1$–$C_{18}$) amine salts thereof, as well as mixtures thereof; about 0.1% to about 10% of an emulsifying agent selected from the group consisting of N-tallow poly(propyleneamine) having from 1 to 5 propyleneamine groups, oxazoline waxes and mixtures thereof, up to about 5% of a corrosion inhibitor comprising a salt of an organic carboxylic acid of $C_7$–$C_{18}$ and an aliphatic amine up to $C_{12}$, a chelating agent comprising ethylenediaminetetraacetic acid (EDTA) and the partial and tetra alkali metal and ammonium salts thereof present in an amount of about 0.25 to about 3% by weight, and water. The operating bath composition can be conveniently prepared from a concentrate incorporating the aforementioned essential constituents in the upper concentration range enabling operating bath makeup or replenishment by simply diluting with water to a lower concentration.

The operating bath is controlled at a pH above that at which excessive pickling of the metal surface occurs and below that pH at which an insufficient reaction with the metal surface occurs to produce an acceptable conversion coating. The bath and concentrate may further optionally incorporate ion activating agents of the types conventionally employed in conversion coating compositions including heavy metal cations such as zinc in conventional amounts.

In accordance with the process aspects of the present invention, clean metal surfaces are contacted with the aqueous acidic coating composition such as by immersion, flooding, spraying, and the like, for a period of time sufficient to effect the formation of a desired conversion coating thickness incorporating organic lubricant constituents. Ordinarily, time periods of from about 1 to about 20 minutes are satisfactory. The coating composition can be applied at temperatures ranging from about 80° F. up to about 200° F. with temperatures of about 120° F. to about 160° F. being particularly satisfactory. At the completion of the coating operation, the part is subjected to a drying step to effect substantially complete evaporation of water from the coating. Such drying is preferably conducted at elevated temperatures of about 250° F. to about 350° F. in a hot circulating air oven.

Additional benefits and advantages of the present invention will become apparent upon a reading of the description of the preferred embodiments taken in conjunction with the examples provided.

DESCRIPTION OF THE PREFERRED EMBODIMENTS

The percentages and amounts of the several constituents of the lubricant coating composition as herein disclosed and as set forth in the subjoined claims are expressed in terms of a weight basis unless clearly indicated to the contrary.

The aqueous acidic coating composition contains phosphate ions in a controlled amount effective to produce a phosphate conversion coating on the metal surface, an organic emulsified lubricant additive possessing lubricity characteristics in an amount to enhance the lubricity of the composite coating formed, a controlled amount of specific emulsifying agents present in an amount to maintain the lubricant additive dispersed in the form of a substantially stable emulsion over the operating conditions of the bath, an organic corrosion inhibiting agent as an optional constituent present in an amount effective to inhibit corrosion of the coated parts during the drying stage, a chelating agent for overcoming the adverse effects of excessive iron concentration in the bath and which further provides corrosion inhibition of the metal surfaces during the drying stage, and water. The coating formulation may additionally contain as optional constituents, activating ions of any of the types usually employed in phosphate conversion coating baths which are compatible with the essential constituents present and in amounts sufficient to effect an activation of the formation of the conversion coating.

In accordance with the composition aspects of the present invention, the aqueous acidic operating bath contains from about 0.2% to about 15% phosphate ions, from about 0.3% to about 16% of an emulsified organic lubricant, about 0.1% to about 10% of the emulsifier, up to about 5% of the organic corrosion inhibitor agent, from about 0.25 to about 3% of the chelating agent, and water. In accordance with the preferred practice, the phosphate ion concentration ranges from about 1.5% to about 6%, the lubricant agent ranges from about 2% to about 6%, the emulsifying agent ranges from about 0.5% to about 4%, the corrosion inhibitor ranges from about 0.5% to about 1.5% and the chelating agent ranges from about 0.5% to about 2% by weight. Of the various activating ions suitable for use, heavy metal cations such as zinc can be employed in amounts sufficient to promote the formation of a phosphate coating to amounts below that at which undesirable bath instability occurs, with amounts of about 0.1% to about 0.2% being typical. The operating bath may further include compatible pH adjusters to provide the desired pH of the operating bath. Usually, the phosphate ion concentration is controlled so as to provide the satisfactory pH obviating the need for pH adjusting agents.

The operating bath may range in acidity from a lower pH value at which excessive acid pickling begins to occur to an upper pH value at which insufficient bath reactivity begins to occur preventing formation of a satisfactory coating. Usually, a pH ranging from about 2.4 to about 3.4 is satisfactory while a pH of from about 2.8 to about 3.1 is preferred.

The phosphate ion constituent of the bath can be suitably introduced in the form of a concentrated phosphoric acid. Zinc may be suitably introduced as zinc oxide in a concentration of from about 0.1 to about 1% zinc. Preferably, the phosphoric acid and zinc oxide may be precombined to form a zinc acid phosphate which may then be used to supply both zinc and phosphate constituents. The presence of the heavy metal zinc cation is preferred particularly in the preparation of a fresh bath to activate the composition. During use of the coating bath, dissolution of iron from the metal surface occurs further providing iron cations in the coating bath. A portion of the metal cation activators are removed as a result of dragout and are replenished by dissolution of iron from the metal surface as well as by periodic replenishment of the coating bath with a concentrate containing such activators, if desired.

In addition to the heavy metal cations, the bath and concentrate may further contain conventional accelerators and activators as well as pH adjusters of the types and in the concentrations conventionally employed which are compatible with and do not adversely affect the stability of the emulsion. Generally, the inclusion of such supplemental additives is not necessary to achieve satisfactory coating results.

The lubricant constituent of the bath comprises an organic emulsifiable carboxylic acid and/or alcohol containing from 8 to 40 carbon atoms as well as esters, mono and polyamine and/or mono and polyalkyl ($C_1$–$C_{18}$) amine salts as well as mixtures therof. The lubricant constituent may be of a saturated or unsaturated form and of a natural or synthetic origin.

The lubricating agent may be comprised of up to 50% of the total lubricant present of N-tallow-1,3 propanediamene dioleate which possesses good film forming properties and acts as a boundary lubricant. This lubricant additive also possesses emulsifying properties and has cationic activity further contributing to the provision of a substantially stable emulsion.

In addition to the aforementioned phosphate ions and lubricant additives, the bath further contains as an emulsifier, N-tallow poly(propyleneamine) having from 1 to 5 propyleneamine groups of a composition corresponding to the following structural formula:

$$R—[NH—CH_2—CH_2—CH_2]_n—NH_2$$

wherein:

R is tallow and n is 1 to 5 or mixtures thereof and/or a series of oxazoline compounds which are synthetic was derivatives of oxazoline, a five-membered heterocyclic ring compound, corresponding to the following structural formula:

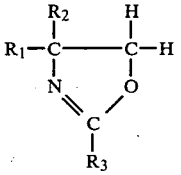

wherein: $R_1$, $R_2$ and $R_3$ are the same or different and are selected from the group consisting of esters, alcohols, carboxylic acids and hydrocarbons containing 1 to 36 carbon atoms and $R_2$ may also be H.

Examples of such oxazoline compounds in accordance with the foregoing structural formula which are effective and commercially available under the brand designation Wax TS 254, Wax TS 254 A, Wax TS 254 AA, Wax TS 970, Alkaterge E and Alkaterge T which are available from NP Division of IMC Chemical Group, Inc. of Hillsdale, Ill.

The oxazoline emulsifying agent imparts stability to the emulsified operating bath, particularly when heated for extended time periods above about 160° F. At such elevated temperatures under the acidic conditions present, the organic lubricant additives in the bath tend to hydrolyze and demulsify as evidenced by a floating oily layer on the surface of the bath. The use of the oxazoline emulsifying agent by itself or in combination with supplemental emulsifying agents imparts increased stability to the emulsion at such high temperatures and for this reason constitutes the preferred emulsifying agent.

The foregoing emulsifier agents also possess some lubricity characteristics and further contribute to the lubricating properties of the deposited coating.

In addition to the foregoing constituents, the bath further contains as an optional, but preferred constituent, an organic corrosion inhibitor comprising a salt of a $C_7$–$C_{18}$ carboxylic acid and an aliphatic amine containing up to $C_{12}$, preferably, a salt of an alkanolamine of which the salt of octanoic acid and triethanolamine and the salt of stearic acid and triethanolamine constitute the preferred materials. A corrosion inhibitor of the foregoing type reported to contain 40% triethanolamine octanoate suitable for use in accordance with the present invention is available under the brand designation Synkad 303, which is available from Keil Chemical Division of Ferro Corporation, Indiana, U.S.A., in the form of a solution having a viscosity of 230 SUS, at 100° F.; a specific gravity of 1.07 g/ml at 77° F. This commercial corrosion inhibiting agent contains about 30% volatiles and a preferred form designated as Synkad 303 HT of increased concentration is preferably employed.

The improved stability and prolonged operating life of the bath as well as inhibition of rust formation on metal surfaces during the drying stage is based on the present discovery of incorporating a controlled amount of the chelating agent in the bath. The chelating agent comprises EDTA as well as the partial and tetra alkali metal and ammonium salts thereof. The chelating agent is used in amounts of about 0.25% up to amounts below that at which emulsion instability of the bath occurs which will vary depending on the types and concentrations of the other constituents present. Usually, concentrations of the chelating agent of up to about 3% by weight can be employed while concentrations of about 0.5 to about 2% are preferred.

The use of the chelating agent not only enhances the stability of the emulsion even when iron concentrations in the bath attain levels of about 0.2% and greater, but unexpectedly, the chelating agent also imparts corrosion inhibiting properties to the bath in the absence of other corrosion inhibiting agents. Surprisingly, the rust inhibiting action of the optional corrosion inhibiting agent is synergistically enhanced by the inclusion of the chelating agent. Because excessive concentrations of either the corrosion inhibiting agent and the chelating agent cannot be used due to the adverse effects on bath stability, the synergism between these two agents enables the use of compatible concentrations of each constituent attaining a corrosion inhibiting effect unattainable by the use of either agent by itself.

It has been further discovered in accordance with the present invention, that an operating bath which has become unstable due to the increase in iron concentration as a result of use can be rejuvenated and restored to stability with agitation by the addition of a controlled effective amount of the chelating agent. It has also been observed in some instances that the inclusion of the chelating agent of the present invention appears to increase the rate of drying of the metal surfaces during the drying stage thereby providing still further benefits by the savings achieved in time and energy.

The foregoing essential constituents in combination with the optional ingredients as hereinabove described are employed in the operating bath in the concentrations as previously set forth. Phosphate ion concentrations of less than about 0.2% are generally unsatisfactory because of the excessive time required to form a phosphate coating of the requisite weight while concentrations in excess of about 15% are undesirable because of the tendency of such higher concentrations to cause instability of the emulsion under some circumstances. The lubricant additive can be employed in amounts of 0.3% to about 16% since amounts less than about 0.3% are undesirable because of insufficient lubricity of the coating for some metal forming operations while amounts in excess of about 16% are unsatisfactory because of the excessive viscosity of the operating bath. The emulsifying agent should be employed in the amount necessary to emulsify the lubricant constituent present and will vary in the disclosed range in consideration of the concentration of lubricant present. The corrosion inhibitor is employed in the operating bath up to about 5%. Amounts of the corrosion inhibitor in excess of about 5% are undesirable because no significant improvement in corrosion inhibition is obtained over that obtained at concentrations of 5% or less and such excessive concentrations contribute toward instability.

The foregoing operating bath is conventionally prepared employing a concentrated solution of the constituents within the permissible upper concentration limits which is suitable after dilution with water to form an operating bath of the desired lower concentration. While such a concentrated solution can itself be employed as the operating bath in some situations, the relatively high viscosity of such concentrates makes it desirable to dilute them with water to produce an operating bath within the preferred concentration ranges as hereinbefore set forth.

A concentrate suitable for further dilution with water can be conveniently prepared by mixing the lubricating agent and emulsifying agent and heating the mixture to form a molten mass. A hot aqueous solution is prepared containing the phosphate ions and supplemental optional aqueous soluble constituents to which the molten organic mixture is slowly added in the presence of vigorous agitation effecting a dispersion of the organic phase into globules forming an emulsion. The aqueous phosphate solution is preferably heated within a range of about 160° to about 200° F. and maintained within that range during the addition of the organic mixture. The resultant emulsified concentrate is thereafter cooled.

It is also contemplated that the emulsifying agent can be added directly to the heated aqueous phosphate solution whereafter the molten lubricant additive is added in the presence of agitation.

The resultant concentrate can be directly employed or can be further diluted with water to prepare an operating bath by the addition of appropriate quantities of water to provide the desired final concentration. The resultant bath is preferably heated to an elevated temperature during use to increase the activity and formation of the phosphate conversion coating. The emulsified particles of lubricant in the concentrate may solidify depending on their specific melting point during the cooling of the concentrate. Such solid particles nevertheless remain dispersed in the aqueous phase. Upon subsequent heating of the coating bath, certain of the particles depending upon their melting point may again become molten. The specific form of the particles as liquid globules or solid particles is immaterial to the formation of a satisfactory lubricant coating on the metal surfaces.

The operating bath can be employed at temperatures ranging from ambient temperature up to about 200° F. with temperatures of from about 120° F. to about 160° F. being particularly satisfactory. The coating bath composition can be applied to the metal surface by flooding, immersion, spraying, and the like, so as to provide intimate contact therebetween. The duration of the contact time will vary depending upon the composition of the coating composition, the concentration thereof, the temperature of application, and the desired coating weight required in consideration of the severity of the metal forming operations to which the articles are to be subjected. Ordinarily, contact times employing an immersion technique of from about one minute up to about twenty minutes is satisfactory. The coating formed comprises a phosphate coating having lubricant particles occluded therein or deposited thereon.

The coated article at the conclusion of the contact time is subjected to a drying stage prior to metal forming. The drying step can be accomplished at temperatures ranging from ambient temperature up to about 350° F. with temperatures of from about 250° F. to about 350° F. being preferred due to the accelerated drying rate obtained. During the drying step at elevated temperature, the lubricant particles may coalesce into a film. Such coalescense, however, is not important in achieving satisfactory lubricant coatings in that solid particles dispersed in or on the phosphate coating also provide for satisfactory lubricity during subsequent metal working operations.

The metal articles prior to the coating operation are subjected, if necessary, to conventional precleaning treatments to remove contaminating substances and scale from the surfaces thereof providing for a clean surface.

In order to further illustrate the present invention, the following specific examples are provided. It will be understood that the examples are provided for illustrative purposes and are not intended to be limiting of the scope of the present invention as herein described and as set forth in the subjoined claims.

EXAMPLE I

A concentrate is prepared containing 2.6% zinc acid phosphate (14% zinc, 48% $PO_4$), 5.6% phosphoric acid (75%), 2.0% N-tallow polypropylene tetramine emulsifying agent, commercially available under the brand name Jet Amine Tet from Jetco Chemicals, Inc. of Texas; and as a lubricating agent, a mixture of high molecular weight constituents present in an amount based on the total concentrate of 2.9% stearic acid (95% $C_{18}$), 2.5% of partially oxidized high molecular weight acids, esters and alcohols commercially available under the brand name ALOX 600 from Alox Corporation and 2.0% N-tallow, 1,3 propanediamine dioleate, commercially available under the brand name Duomeen TDO from Armak Chemicals Div. of Akzona Incorporated of Chicago, Ill., and the remainder water. The concentrate is employed to make up an operating bath by dilution with water at a ratio of one volume concentrate for one volume water. The resultant operating bath is heated to a temperature of 170° F.

The heated operating bath is employed for processing steel work pieces and during prolonged use of the bath, iron dissolved from the processed work pieces increases in concentration, attaining a level of about 0.2% by weight. An inspection of the bath indicates that the organic constituents in the bath start to agglomerate forming larger particles which eventually demulsify.

EXAMPLE II

A concentrate and operating bath similar to that of Example I is prepared with the exception that 2% by weight of a chelating agent comprising tetrasodiumethylenediaminetetraacetate is added to the concentrate producing a net 1% by weight concentration in the operating bath. The operating bath is employed for processing steel work pieces in a manner as described in Example I and it is observed that when the dissolved iron concentration approaches a concentration in the operating bath of about 0.2%, no agglomeration of the organic constituents is evident and no demulsification of the bath occurs.

EXAMPLE III

An operating bath of a composition similar to that described in Example I, but further including about 1% by weight of a rust inhibiting agent comprising Synkad 303 containing triethanolamine octanoate is employed in a trial production run for applying a lubricant coating to steel tubing to facilitate subsequent drawing. After a prolonged trial run, the iron concentration in the operating bath increases as a result of dissolving iron from the tubes being processed. Agglomeration and demulsification of the bath is also evidenced. The lubricant coating produced on the tubes processed in the aged bath provides less than desirable drawing characteristics and also produce rusting of the tube bundles at their points of contact during the drying stage of the tubes, evidencing a loss of effectiveness of the rust inhibiting agent. The addition of 1% by weight of tetrasodiumethylenediaminetetraacetate to the operating bath in the presence of agitation effects a rejuvenation of the bath as evidenced by improved drawing characteristics of the processed steel tubing and the substantial elimination of rusting of the tubes during the drying stage. The rejuvenated bath containing the chelating agent also exhibits surprising increase in the rate of drying of the tubing during the drying state.

EXAMPLE IV

A laboratory sample of the aged and demulsified operating bath as described in Example III is subjected to agitation by stirring at room temperature. Upon cessation of agitation, the bath sample again separates rapidly. The addition of an equivalent of 1% by weight of tetrasodiumethylenediaminetetraacetate to the bath sample with stirring effects a remulsification of the test sample. Upon cessation of stirring, the bath sample remains emulsifed without significant separation for a period of about 48 hours.

EXAMPLE V

Two laboratory batch operating baths are prepared designated sample A, corresponding to the composition of Example I and Sample B of similar composition but further containing an equivalent of 1% by weight of tetrasodiumethylenediaminetetraacetate. Samples A and B are heated to 150° F. and are artifically aged by sequentially immersing 20 steel wood pads (000 grade steel wool each weighing 30 grams), for one hour each. Sample A, comprising the control devoid of any chelating agent undergoes demulsification due to the high dissolved iron concentration. In contrast, Sample B prepared in accordance with the practice of the present invention, remains as a uniform stable emulsion.

EXAMPLE VI

Fresh laboratory batch operating baths without artificial aging corresponding to Samples A and B of Example V are prepared for comparison purposes. Cold rolled steel unpolished panels of a size 3"×4" are cleaned by immersion for a period of five minutes in an aqueous cleaning solution at a temperature of 180° F. whereafter the panels are water rinsed for one minute. The panels are thereafter immersed in Sample Bath A and Sample Bath B, heated to a temperature of about 160° to about 170° F. for a period of ten minutes. Upon extraction from each bath, a pair of the wet coated panels are placed in face to face overlying relationship in a horizontal position and are placed in an oven at 175° F. for a period of one hour. After the one hour drying stage, the facing surfaces of the test panels are examined for rust. An inspection of the test panels treated in Sample A reveals an area of about 30% of rust on the two facing surfaces. An inspection of the test panels treated in Sample B reveals an area of rust of less than about 2% on the two facing surfaces.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An aqueous acidic lubricant coating composition for treating metal surfaces prior to metal forming operations comprising an aqueous emulsion comtaining:

(a) from about 0.2% to about 15% by weight phosphate ions;

(b) from about 0.3% to about 16% of an emulsified organic lubricant selected from the group consisting of $C_8$ to $C_{40}$ carboxylic acids and alcohols including the esters, mono and polyamide salts, mono and polyalkyl ($C_1$–$C_{18}$)amine salts thereof as well as mixtures thereof;

(c) from about 0.1% to about 10% of an emulsifying agent selected from the group consisting of N-tallow poly(propyleneamine) having from 1 to 5 propyleneamine groups, oxazoline waxes and mixtures thereof;

(d) from about 0.25% to about 3% of a chelating agent comprising ethylenediaminetetraacetic acid or the partial or tetra alkali metal or ammonium salts thereof; and (e) water;

said composition having a pH above that at which excessive pickling of the metal surface occurs and below that at which insufficient reaction with the metal surface occurs to form a phosphate coating.

2. The composition as defined in claim 1 in which said lubricant comprises up to 50% of N-tallow-1,3 propane diamine dioleate.

3. The composition as defined in claim 1 further including heavy metal ions.

4. The composition as defined in claim 1 in which said $C_8$ to $C_{40}$ lubricant constituent is comprised of a major portion of $C_8$ to $C_{24}$ constituents.

5. The composition as defined in claim 1 containing:

(a) from about 1.5% to about 6% of said phosphate ions;

(b) from about 2% to about 6% of said lubricant;

(c) from about 0.5% to about 4% of said emulsifier; and (d) from about 0.5% to about 2% of said chelating agent.

6. The composition as defined in claim 1 having a pH of about 2.4 to about 3.4.

7. The composition as defined in claim 1 having a pH of about 2.8 to about 3.1.

8. The composition as defined in claim 3 in which said heavy metal cations are selected from the group consisting of iron, zinc and mixtures thereof.

9. The composition as defined in claim 1 further including from about 0.1% to about 5% of a corrosion inhibitor comprising a salt of a $C_7$–$C_{18}$ carboxylic acid and an aliphatic amine containing up to $C_{12}$.

10. The composition as defined in claim 9 in which said corrosion inhibitor comprises a salt of said carboxylic acid and an alkanolamine.

11. The composition as defined in claim 9 in which said corrosion inhibitor comprises a salt of said carboxylic acid and triethanolamine.

12. The composition as defined in claim 9 in which said corrosion inhibitor comprises a salt of octanoic acid and triethanolamine.

13. The composition as defined in claim 9 in which said corrosion inhibitor comprises a salt of stearic acid and triethanolamine.

14. A method of treating a clean metal surface to form a lubricant coating thereon prior to metal forming operations which comprises the steps of contacting said surface with a composition as defined in claim 1 for a period of time sufficient to form a coating and thereafter drying said surface.

15. The method as defined in claim 14 in which said composition is at a temperature ranging from ambient temperature up to about 200° F.

16. The method as defined in claim 14 in which said composition is at a temperature of about 120° F. to about 160° F.

17. The method as defined in claim 14 in which the step of drying said surface is performed at a temperature ranging from ambient up to about 350° F.

18. The method as defined in claim 14 in which the step of drying is performed at a temperature ranging from about 250° F. to about 350° F.

19. The method as defined in claim 14 in which the step of contacting said surface with said composition is performed for a period ranging from about one to about twenty minutes.

20. The method as defined in claim 14 in which said composition is at a pH of about 2.4 to about 3.4

21. The method of rejuvenation of an aqueous acidic coating composition containing:

(a) from about 0.2% to about 15% by weight phosphate ions;

(b) from about 0.3% to about 16% of an emulsified organic lubricant selected from the group consisting of $C_8$ to $C_{40}$ carboxylic acids and alcohols including the esters, mono and polyamide salts, mono and polyalkl ($C_1$–$C_{18}$)amine salts thereof as well as mixtures thereof; and (c) from about 0.1% to about 10% of an emulsifying agent selected from the group consisting of N-tallow poly(propyleneamine) having from 1 to 5 propyleneamine groups, oxazoline waxes and mixtures thereof, which has become demulsified due to the presence of dissolved iron in the composition comprising the steps of adding to said composition from about 0.25% to about 5% of a chelating agent comprising ethylenediaminetetraacetic acid or the partial or tetra alkali metal or ammonium salts thereof and agitating said composition to restore the emulsion and coating efficiency of said composition.

* * * * *